US005118223A

United States Patent [19]

Taki

[11] Patent Number: 5,118,223

[45] Date of Patent: Jun. 2, 1992

[54] MULTI-SHAFT AUGER APPARATUS AND PROCESS FOR FORMING SOILCRETE COLUMNS AND WALLS AND GRIDS IN SITU IN SOIL

[76] Inventor: Osamu Taki, 2558 Somerset Dr., Belmont, Calif. 94002

[21] Appl. No.: 665,910

[22] Filed: Mar. 7, 1991

Related U.S. Application Data

[63] Continuation-in-part of Ser. No. 172,286, Mar. 23, 1988, Pat. No. 5,013,185.

[51] Int. Cl.[5] ..... E02D 3/12; E02D 5/18

[52] U.S. Cl. ..... 405/267; 405/128; 405/269

[58] Field of Search ..... 405/128, 129, 233, 258, 405/263, 266, 267, 269; 175/323, 394

[56] References Cited

U.S. PATENT DOCUMENTS

| | | | |
|---|---|---|---|
| 4,043,909 | 8/1977 | Endo et al. | 210/49 |
| 4,063,424 | 12/1977 | Takagi et al. | 61/63 |
| 4,065,928 | 1/1978 | Takagi et al. | 61/36 R |
| 4,065,933 | 1/1978 | Katayama | 61/50 |
| 4,069,678 | 1/1978 | Miura et al. | 61/63 |
| 4,084,383 | 4/1978 | Kukino et al. | 61/36 R |
| 4,089,183 | 5/1978 | Endo et al. | 61/50 |
| 4,189,239 | 2/1980 | Miyaguchi et al. | 366/169 |
| 4,212,548 | 7/1980 | Miyaguchi et al. | 366/348 |
| 4,402,630 | 10/1983 | Miura et al. | 405/266 |
| 4,436,453 | 3/1984 | Miura et al. | 405/263 |
| 4,449,856 | 5/1984 | Tokoro et al. | 405/269 |
| 4,475,847 | 10/1984 | Cornely et al. | 405/264 |
| 4,662,792 | 5/1987 | Gessay | 405/233 |
| 4,776,409 | 10/1988 | Manchak | 405/269 X |

FOREIGN PATENT DOCUMENTS

| | | |
|---|---|---|
| 58-29374 | 6/1983 | Japan . |
| 58-29375 | 6/1983 | Japan . |

OTHER PUBLICATIONS

"S. M. W. Machine," Product Brochure of S. M. W. Seiko, Inc.

"Teno Column Method" Product Brochure of the Tenox Corporation (publication date unknown).

"Just One of Our Fleet," Product Advertisement (publication date unknown).

"The Soil Mixing Wall (SMW Technique)-Guidelines for its Design and Implementation," Japanese Materials Institute.

"In Situ Soil Improvement Techniques, Lime Columns" (dated Mar. 1987).

Jasperse and Ryan, "Geotech Import: Deep Soil Mixing," Civil Engineering (Dec. 1987), pp. 66-68.

*Primary Examiner*—David H. Corbin

*Attorney, Agent, or Firm*—Workman, Nydegger and Jensen

[57] ABSTRACT

The present invention is directed to multi-shaft apparatus and methods for forming soilcrete columns and walls and grids in situ in soil whereby adjacent boreholes are drilled so as to reach bedrock at substantially the same time. Each shaft is equipped with a penetrating auger blade at its lower end. Overlapping auger blades, vertically offset from the penetrating auger blades, are attached to alternate shafts. The columns may overlap or be approximately tangential to each other. Columns may be positioned in a row so as to form a wall, or may be positioned in a grid so as to fixate a region of contaminated soil.

37 Claims, 9 Drawing Sheets

MULTI-SHAFT AUGER APPARATUS AND PROCESS FOR FORMING SOILCRETE COLUMNS AND WALLS AND GRIDS IN SITU IN SOIL

RELATED APPLICATION

The present application is a continuation-in-part of copending U.S. patent application Ser. No. 07/172,286, filed Mar. 23, 1988, now U.S. Pat. No. 5,013,185 in the name of Osamu Taki and entitled "MULTI-SHAFT AUGER APPARATUS AND PROCESS FOR FIXATION OF SOILS CONTAINING TOXIC WASTES," which patent application is incorporated herein by specific reference.

BACKGROUND

1. The Field of the Invention

The invention is in the field of apparatus and methods for forming soilcrete columns and walls and grids in situ in soil.

2. The Related Technology

For a number of years, multi-shaft auger machines have been used in Japan to construct concrete-like columns in the ground without having to excavate the soil. These columns are sometimes referred to as "soilcrete" columns. Soilcrete is a term applied to a mixture of soil and a chemical hardener, which sets up as a solid mass, much like concrete. The chemical hardener is injected directly into the soil in situ, and mixed with the soil, by means of an auger, thus avoiding the necessity of removing the soil and replacing it with concrete as is necessary when constructing concrete columns or walls in the soil.

In many cases the soilcrete columns have been overlapped to form boundary walls or structured retaining walls. In other cases the soilcrete columns have been overlapped in orthogonal directions, thus forming a grid. This latter application is particularly useful in situations wherein the soil is contaminated, such as with toxic wastes. The resultant grid solidifies as a solid mass, substantially impervious to migration of the contaminants as a result of ground water flow.

The related technology discloses apparatus and methods for forming, in situ, adjoining soilcrete columns in soil wherein two or more overlapping boreholes are simultaneously formed by joined and cooperating augers actuated by a drilling rig, wherein adjacent augers are both horizontally and vertically offset from each other, and positioned with respect to each other such that the augers avoid interfering with each other while still allowing the resultant boreholes to overlap. Normally the boreholes are augered down to bedrock, and usually slightly into the bedrock so as to key into it. However, since adjacent augers are necessarily vertically offset in order to avoid interference with each other while still forming overlapping boreholes, one or more augers will reach bedrock before the adjacent one or ones do so. It then becomes necessary to drill the first auger(s) substantially into the bedrock until the adjacent auger(s) reach the bedrock. This is a time-consuming, costly, and functionally unnecessary operation which it would be desirable to avoid if possible.

In most applications it is preferred that the columns be formed so as to be overlapping with no, or at least a minimum, of interstitial spaces therebetween. This leads to the problem as noted above wherein adjacent augers do not reach bedrock at the same time. Thus the problem to be solved in order to improve over the prior art is to conceive apparatus and methods which will permit the augers to reach bedrock substantially simultaneously and yet will permit the soilcrete columns to overlap.

BRIEF SUMMARY AND OBJECTS OF THE INVENTION

As indicated above, the use of existing apparatus makes it desirable to auger some of the boreholes substantially into bedrock in order to achieve a condition wherein all of the boreholes reach bedrock. In addition to being a timeconsuming, costly, and functionally unnecessary operation, this exacerbates the operation of the equipment wherein one auger is drilling into bedrock while a connected adjacent auger is drilling in soil.

Therefore, it is an object of the present invention to provide apparatus and methods which will permit adjacent overlapping boreholes to be simultaneously formed, wherein the penetrating augers reach bedrock substantially simultaneously, and wherein the final soilcrete columns all rest on or key into the bedrock.

This is achieved in one embodiment of the instant invention by equipping a multi-shaft drilling rig with a multishaft auger apparatus having three parallel, vertically oriented, and coplanar augers, each auger shaft being equipped with a penetrating auger blade substantially aligned horizontally with the other auger blades, and sized and spaced so as to avoid interference, and additionally having a flat overlapping auger blade keyed to the shaft of the central auger, and offset vertically somewhat above the penetrating auger blade. The flat overlapping auger blade has a diameter somewhat greater than the central penetrating auger blade and is large enough and fabricated such that its resultant borehole overlaps the boreholes of the other two adjacent penetrating auger blades. Thus, all three resultant soilcrete columns will overlap and will reach to bedrock.

It is realized that the central column will have a slight interstice, at its lower extremity only, between itself and the adjacent columns. However, this will be of no practical significance. As can be readily seen this arrangement obviates the necessity of drilling substantially into the bedrock.

The penetrating auger blades may have the same or differing diameters. It is anticipated that the central auger blade will usually have a smaller diameter than the adjacent auger blades. Likewise the overlapping auger blade may have a diameter equal to or greater than the blades of the adjacent augers. Of course, its diameter must always be greater than the penetrating blade of the central auger.

The resultant boreholes are simultaneously supplied with a chemical hardener by way of the augers which mixes with the augered soil and which subsequently hardens to form soilcrete, a material somewhat similar to concrete in its physical properties. Thus, overlapping columns of soilcrete are formed which may extend down to bedrock. A series of overlapping columns may then be effected in a line so as to form a wall as described in my U.S. Pat. No. 4,909,675 entitled "In Situ Reinforced Structural Diaphragm Walls and Methods of Manufacturing" and issued Mar. 20, 1990.

In another application a multitude of overlapping columns may be effected in the form of a grid so as to fill an area as described in my co-pending patent application Ser. No. 07/172,286 entitled "Multi-shaft Auger Apparatus and Process for Fixation of Soils Containing Toxic Wastes" and filed fixate) regions of contaminated soil since the final soilcrete, which consists of the contaminated soil and hardeners, hardens into a compact mass which is impervious to water, and thus becomes "fixed" in pollution terminology.

In another embodiment of the invention, the central penetrating auger blade is positioned so as to be slightly higher than the adjacent penetrating auger blades. In other respects the embodiment is the same as described above. This arrangement may prove to have practical advantages from an equipment or operational standpoint. A disadvantage is that the outer augers must be drilled slightly further into the bedrock than is the case for the first embodiment, or alternatively the seated column may not quite reach bedrock.

In still another embodiment of the invention an auger apparatus incorporating five augers is employed. In this embodiment the two outside penetrating auger blades and the central penetrating auger blade will normally, but not necessarily, have the same diameter and the intervening penetrating auger blades will have smaller diameters.

In still another embodiment of the invention an auger apparatus incorporating two augers is employed. In still another embodiment of the invention an auger apparatus having three augers in a triangular, rather than a coplanar, arrangement is employed. Obviously other embodiments having other than two, three, or five augers may be employed. It is only necessary to provide suitable drilling rigs. The number of augers employed will generally be determined by the project criteria for which the invention is utilized.

In any of the above embodiments, soil mixing paddles may be attached to the shafts as disclosed in my copending U.S. patent application Ser. No. 07/172,286 entitled "Multi-shaft Auqer Apparatus and Process for Fixation of Soils Containing Toxic Wastes," filed Mar. 23, 1988. Likewise, additional penetrating auger blades may be attached to the shafts.

DETAILED DESCRIPTION OF THE PREFERRED EMBODIMENTS

Reference is now made to the drawings wherein like parts are designated with like numerals throughout.

Figure 1:
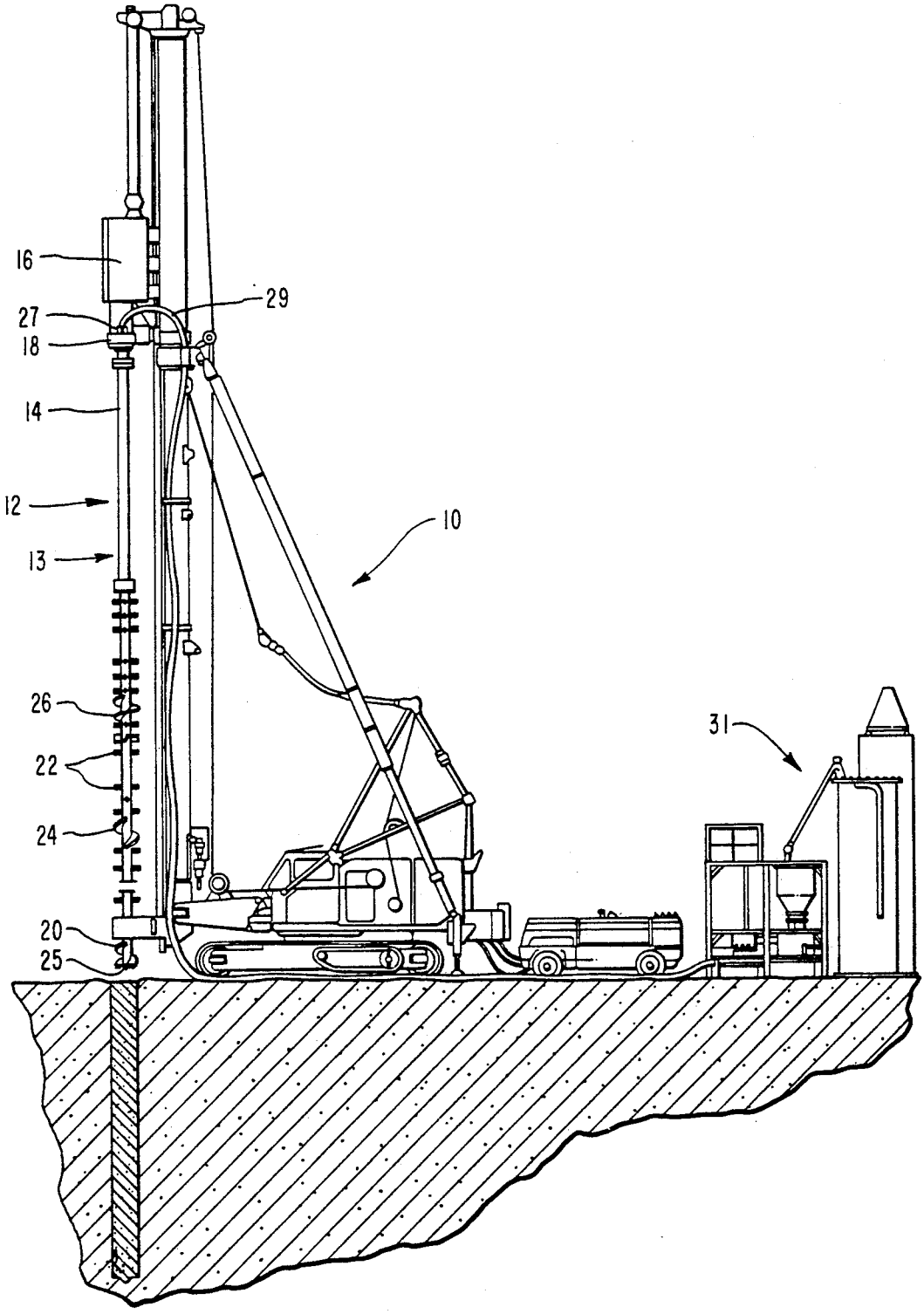
FIG. 1 is an elevation view of one presently preferred embodiment within the scope of the present invention as it would appear in operation.

Referring to FIG. 1, a conventional drilling rig 10 is shown coupled to a multi-shaft auger apparatus 12 of the present invention, only one auger 13 being visible in the figure. Auger 13 has a shaft 14 which is driven by motor 16 through gear box 18 at the upper end of the shaft. Motor 16 and gear box !8 are components of drilling rig 10 and are not part of the present invention. Attached to the lower end of the shaft is a penetrating auger blade 20. Mixing paddles 22 are also shown attached to the shaft at various positions along the shaft. Additional penetrating auger blades 24 and 26 are also shown attached to the shaft.

In practice auger 13, and cooperating augers (not shown), which together comprise one embodiment of the present invention, are rotated in unison by one or more motors of the drilling rig, the result being that boreholes are effected in the soil or rock formation. Of course, as the holes are bored, the augers are moved downwardly by the drilling rig.

As each hole is bored, a chemical hardener is introduced into the existing bottom of the hole through a passageway such as 23 (shown in phantom in FIG. 2) in the shaft, by way of a discharge opening 25 at the bottom of the shaft. This chemical hardener is introduced into passageway 23 by way of rotary valve 27 supplied through conduit 29 from a grout plant 31, the valve, conduit, and grout plant being of conventional design and not part of this patent. This chemical hardener will typically include cement or cement products, bentonite, asphalt, and/or other hardeners or aggregates. This hardener is mixed with the augered soil both by action of the auger blades and the mixing paddles so as to form a generally homogenous mixture.

The resulting mixture of soil and chemical hardener is generally referred to as "soilcrete," because the hardened mixture often possesses physical properties similar to concrete. Nevertheless, use of the term "soilcrete" does not mean that soil is mixed with concrete or even that the chemical hardener necessarily contains cement. The constituents of the particular hardener to be used in any given situation depends on the particular soil at the location.

The holes are normally bored to bedrock, or slightly into the bedrock when it is desired to key the resultant soilcrete columns to the bedrock. Following formation of the soilcrete columns the augers are withdrawn from the boreholes.

If desired, structural members such as "I beams" may then be inserted into some or all of the boreholes as disclosed in my U.S. Pat. No. 4,909,675 entitled "In Situ Reinforced Structural Diaphragm Walls and Methods of Manufacturing," issued Mar. 20, 1990. As will be described more fully later on, adjacent soilcrete columns may be overlapped so as to provide a continuous support structure, wall, or barrier.

In another application, contaminated soil may be "fixed" (i.e., locked in place) by effecting a grid of overlapping soilcrete columns, overlapped in two orthogonal directions, so as to provide a volume of soil substantially filled with the contaminated soil hardened into soilcrete, having, at the most, only superficial interstices therein. The resultant mass of soilcrete is substantially impervious to water and thus prevents the contaminants from migrating outward through the action of groundwater or other mechanisms. This process is more fully disclosed in my aforementioned copending U.S. patent application Ser. No. 07/172,286.

The present invention discloses novel apparatus and methods for effecting the overlapping soilcrete columns and walls as is discussed herewith.

Figure 2:
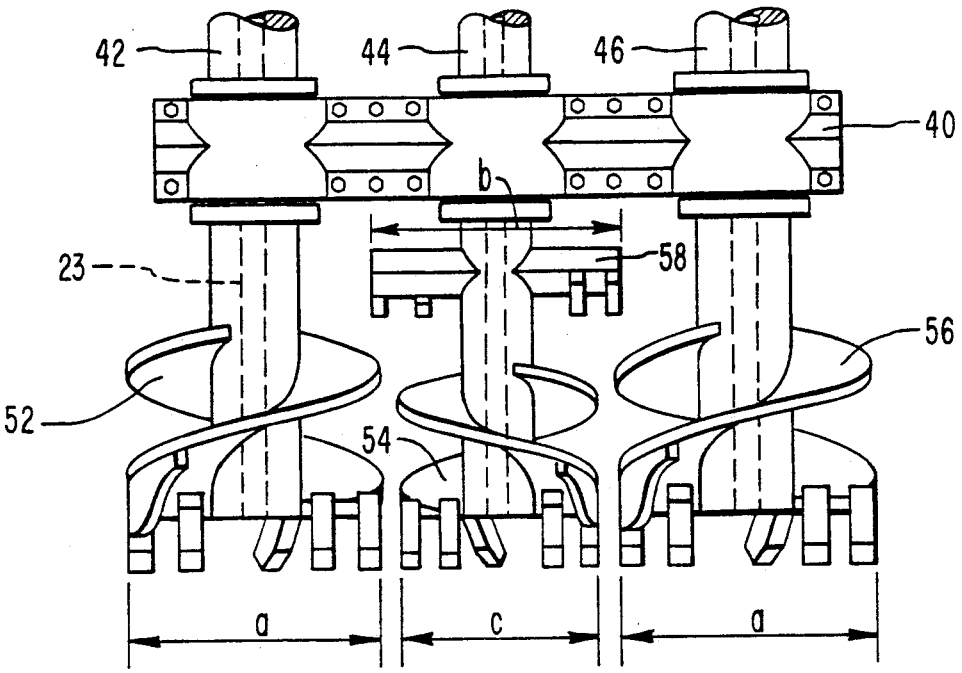
FIG. 2 is an elevation view of one presently preferred embodiment of the multi-shaft auger apparatus having three shafts, showing three horizontally aligned penetrating auger blades and an overlapping auger blade.

One embodiment of the present invention is depicted in FIG. 2 which shows a multi-shaft auger apparatus having three shafts in a coplanar arrangement with three penetrating auger blades and one overlapping auger blade. The three shafts are fixedly positioned with respect to each other by a stationary support structure 40 which is journaled to shafts 42, 44, and 46 by conventional means not further described herein. Shafts 42, 44, and 46 have corresponding auger blades 52, 54, and 56 attached at their lower ends as shown.

Auger blade 54 has a smaller diameter than auger blades 52 and 56. Each of these blades, as shown, is of the type having a spiral inclined-plane blade, with a cutting edge at its lower extremity, and downwardly projecting auger teeth. Although this particular type of auger blade is shown as preferred, other types of auger blades may be employed.

Figure 5:
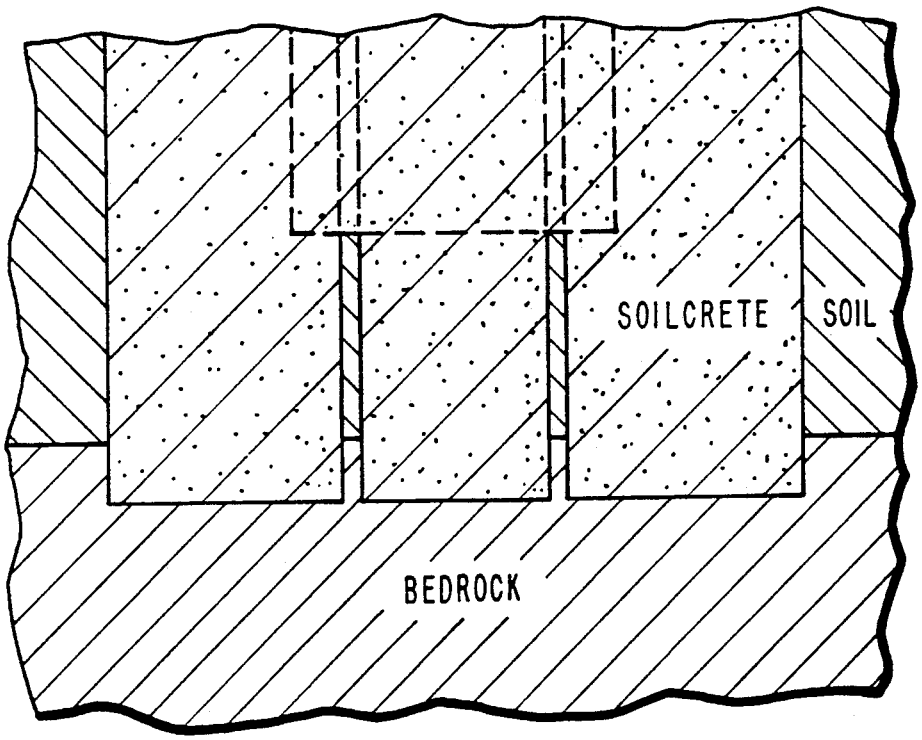
FIG. 5 is a cross-sectional elevation view of the three overlapping soilcrete columns effected by the auger apparatus of FIG. 2.

Additionally, there is an overlapping auger blade 58 attached to shaft 44, offset somewhat vertically from auger blade 54. Auger blade 58 has a diameter "b" larger than the diameter "c" of auger blade 54, and indeed is sized so as to overlap auger blades 52 and 56. Preferably "b" will be equal to "a," the diameter of auger blades 52 and 56, although "b" may be greater than "a," or even less than "a." The resultant overlapping soilcrete columns are shown in FIG. 5.

Figure 7:
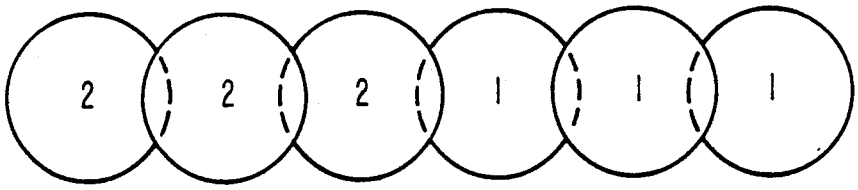
FIG. 7 is a cross-sectional view of two sets of boreholes effected by the apparatus of FIG. 2 showing overlap between the sets and two auger strokes.
Figure 8:
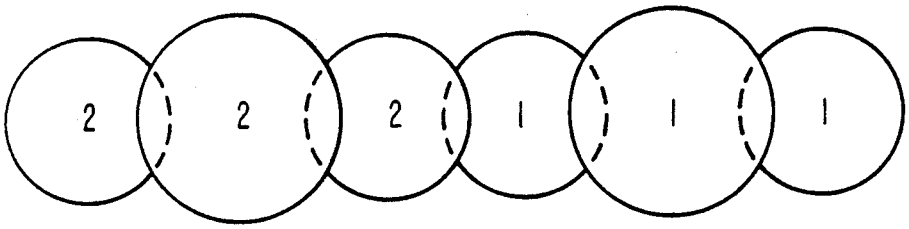
FIG. 8 is a cross-sectional view of two sets of boreholes effected by the apparatus of FIG. 4 showing overlap between the sets and two auger strokes.

Following the boring of the holes and the mixing of the soilcrete the auger apparatus is withdrawn from the boreholes, leaving the borehole filled with the soilcrete mixture in the soil, and the drilling rig is moved to a new location. When a continuous soilcrete wall is to be effected one of the outer shafts, such as 46, will be positioned so as to cause auger blade 56 to overlap the borehole previously effected by auger blade 52. This is depicted in FIGS. 7 and 8 wherein the boreholes effected by a first drilling operation (hereafter called "auger stroke") are labeled "1," and the boreholes effected by the second auger stroke are labeled "2."

Figure 9:
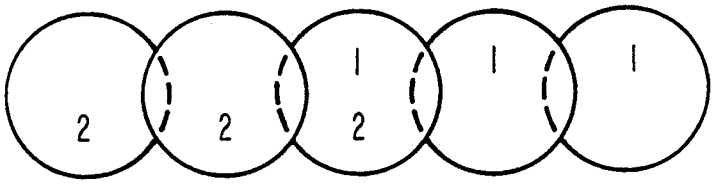
FIG. 9 is a cross-sectional view corresponding to FIG. 7 depicting an alternate auger stroke arrangement.
Figure 10:
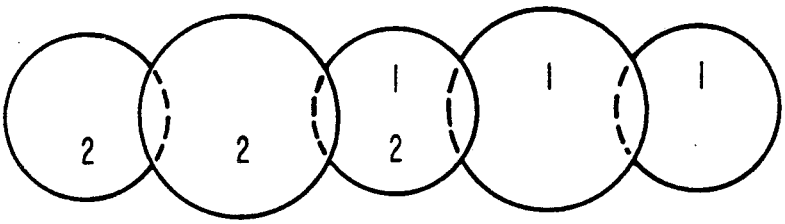
FIG. 10 is a cross-sectional view corresponding to FIG. 8 depicting an alternate auger stroke arrangement.

It can be appreciated that many different types of soil are excavated in the world. For some soils, particularly sandy soils, a different auger stroke may be preferred, as depicted in FIGS. 9 and 10 wherein the second auger stroke is effected by positioning one outside auger directly over an outside borehole effected by the first auger stroke. As before, the boreholes are labeled "1" and "2."

Figure 11:
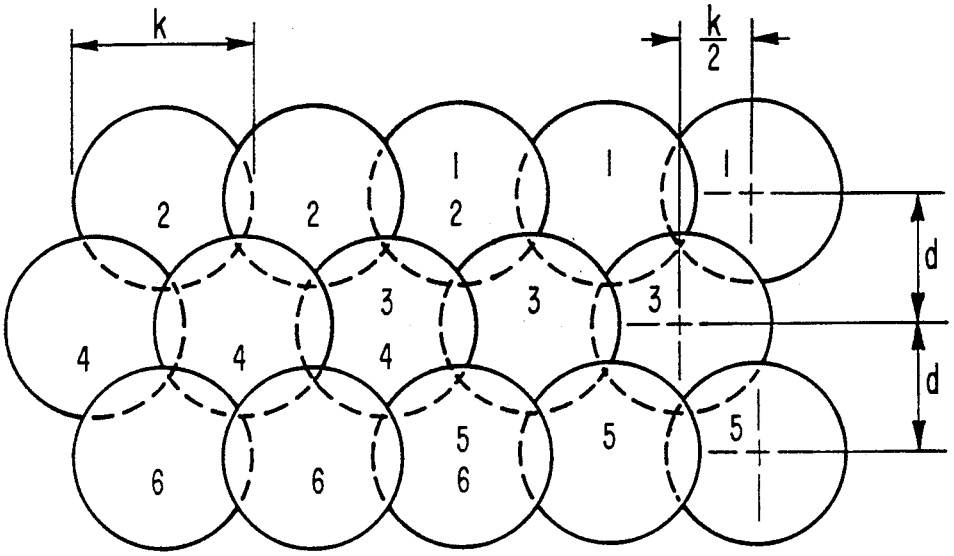
FIG. 11 is a cross-sectional view showing a grid comprised of three lines of overlapping boreholes effected by the apparatus of FIG. 2.
Figure 12:
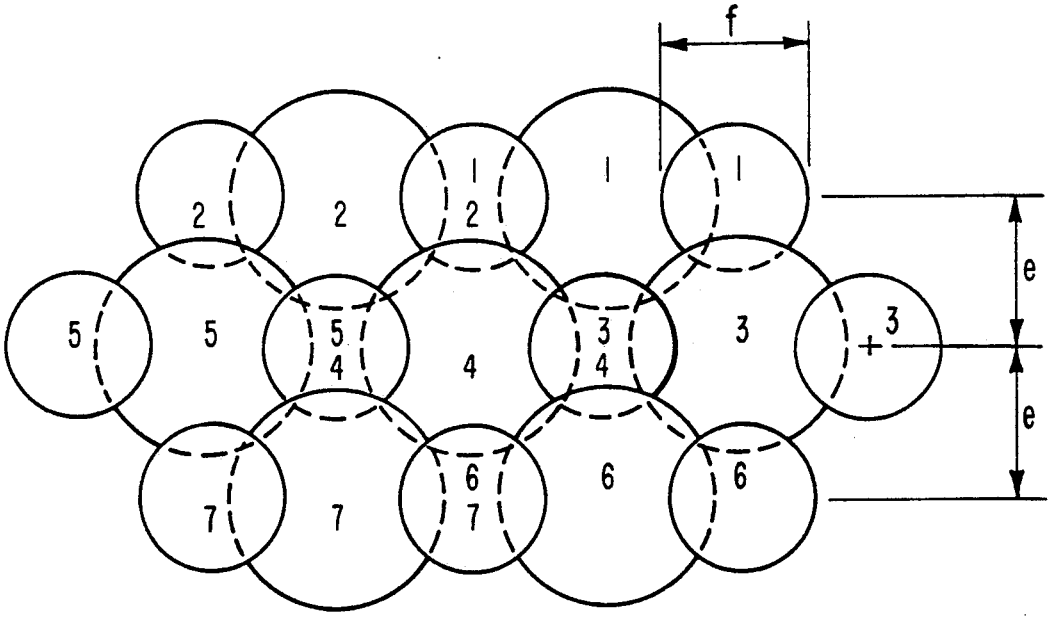
FIG. 12 is a cross-sectional view showing a grid comprised of three lines of overlapping boreholes effected by the apparatus of FIG. 4.

The embodiment wherein "b" is greater than "a" has particular application to the fixation of areas of contaminated soil wherein it is desired to emplace a grid of substantially overlapping soilcrete columns over an extended area. In this application, boreholes are effected in a row as shown in FIGS. 9 or 10 and subsequent overlapping rows are effected, as shown in FIGS. 11 or 12. More rows may be added until the desired area is covered. Note that in FIG. 11 each row is offset from an adjacent row by a distance equal to "k/2" where "k" is the diameter of a column, and the spacing "d" between rows is less than "k." Note that in FIG. 12 each row is offset from an adjacent row by a distance "e" which is approximately equal to the diameter of a small diameter column "f." Note also that large diameter columns are orthogonally positioned from small diameter columns in adjacent rows.

The advantage of employing an overlapping auger wherein "b" is greater than "a" is evident by comparing FIGS. 11 and 12. In each situation overlap has been effected so as to minimize or eliminate interstitial regions between soilcrete columns. However, since the distance "e" between rows of boreholes as depicted in FIG. 12 is greater than the distance "d" as depicted in FIG. 11 fewer rows will be required, i.e., when an enlarged overlapping auger blade is used. Note that in FIG. 11 each row is offset horizontally by a distance equal to one-half of the column diameter whereas in FIG. 12 each column of larger diameter is orthogonally positioned from a smaller-diameter column in an adjacent row.

Figure 3:
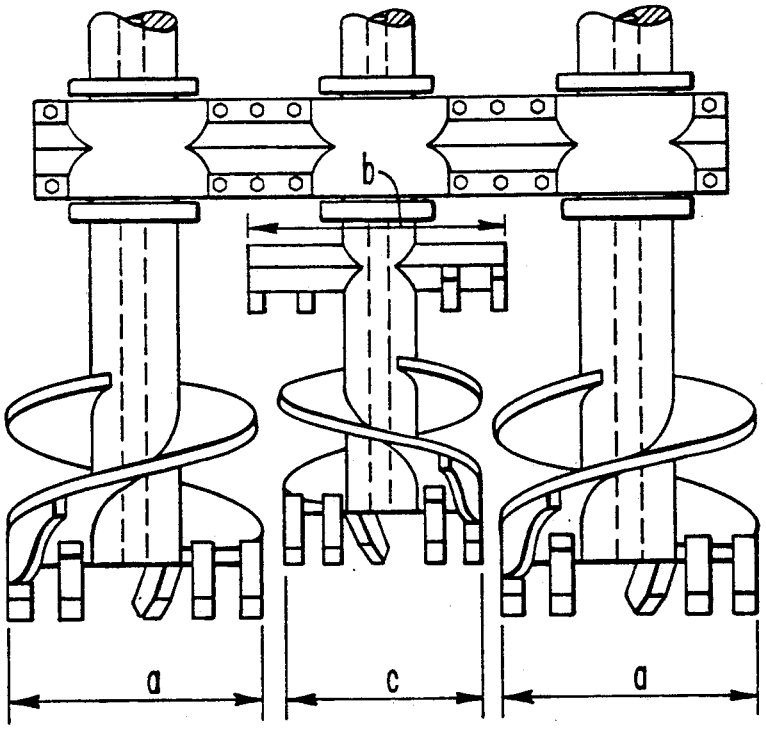
FIG. 3 is an elevation view of another presently preferred embodiment of the multi-shaft auger apparatus having three shafts, showing three penetrating auger blades with one of them being offset vertically from the other two, and an overlapping auger blade.
Figure 4:
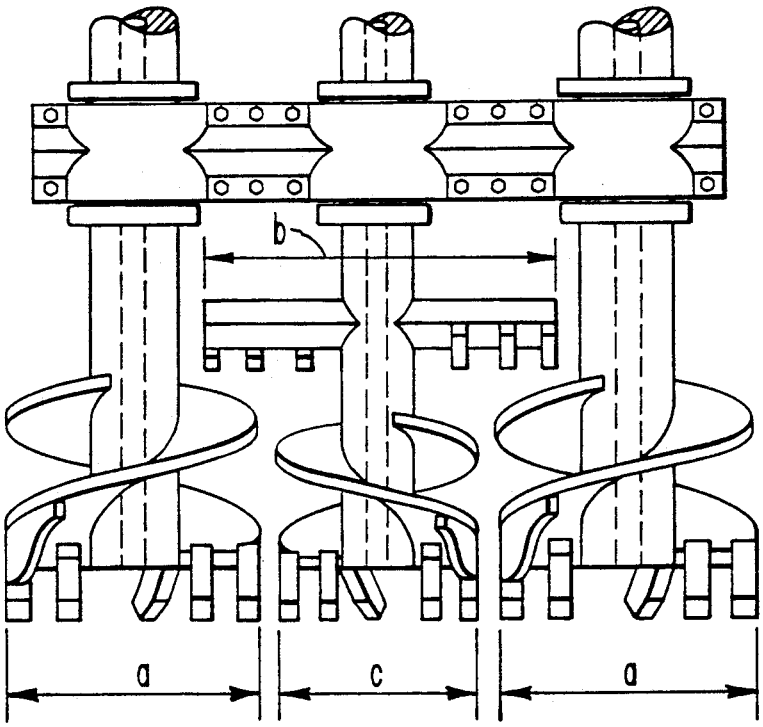
FIG. 4 is an elevation view of another presently preferred embodiment of the multi-shaft auger apparatus corresponding to FIG. 2, but having an enlarged overlapping auger blade.
Figure 6:
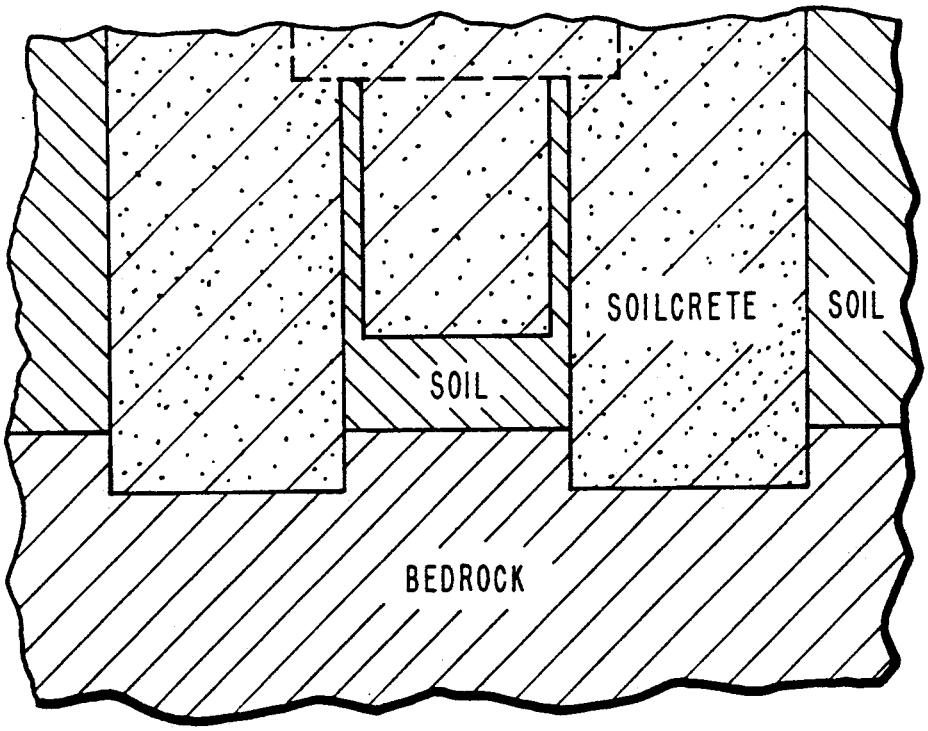
FIG. 6 is a cross-sectional elevation view of the three overlapping soilcrete columns effected by the auger apparatus of FIG. 3.

Another embodiment of the present invention is depicted in FIG. 3. As shown this is similar to FIG. 2 except that the central penetrating auger blade is slightly offset vertically. This embodiment will prove desirable in certain types of soil, and in particular in situations where it is not essential that the central soilcrete columns reach all the way to the bedrock. As shown in FIG. 6, a short column of soil may be left between the bottom of the central soilcrete column and the bedrock.

Figure 13:
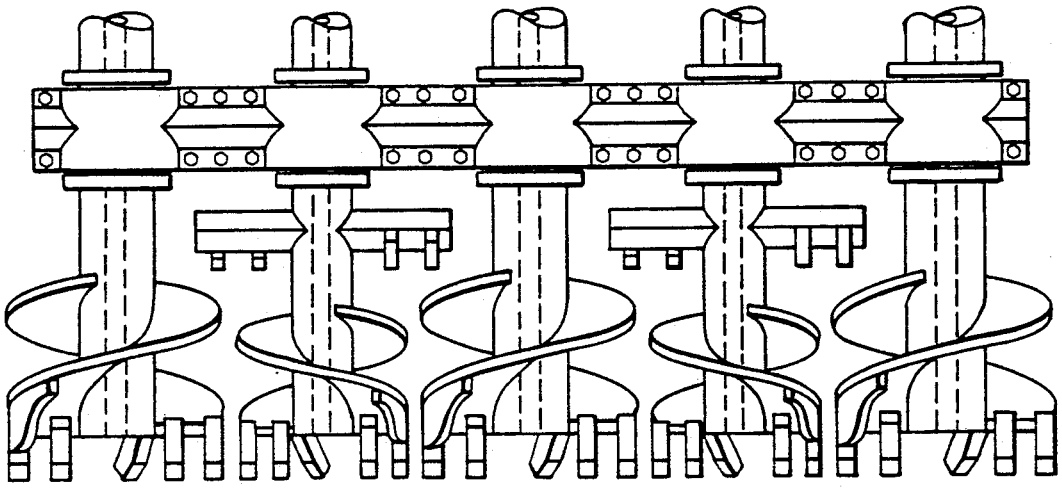
FIG. 13 is an elevation view of one presently preferred embodiment within the scope of the invention showing five horizontally aligned penetrating augers and two overlapping augers.

A still further embodiment of the present invention is depicted in FIG. 13. This is similar to FIG. 2 except that five coplanar augers are employed. Obviously, still larger numbers of augers may be employed if desired and if suitable drilling rigs are made available.

Figure 14:
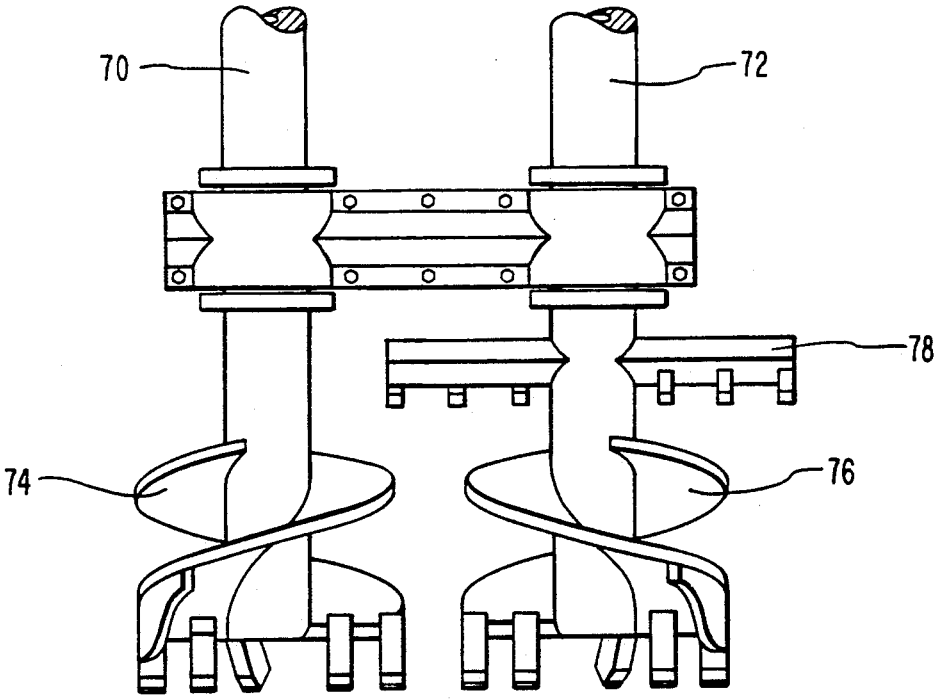
FIG. 14 is an elevation view of another presently embodiment of the multi-shaft auger apparatus having two shafts and showing two horizontally aligned penetrating auger blades and one overlapping auger blade.
Figure 15:
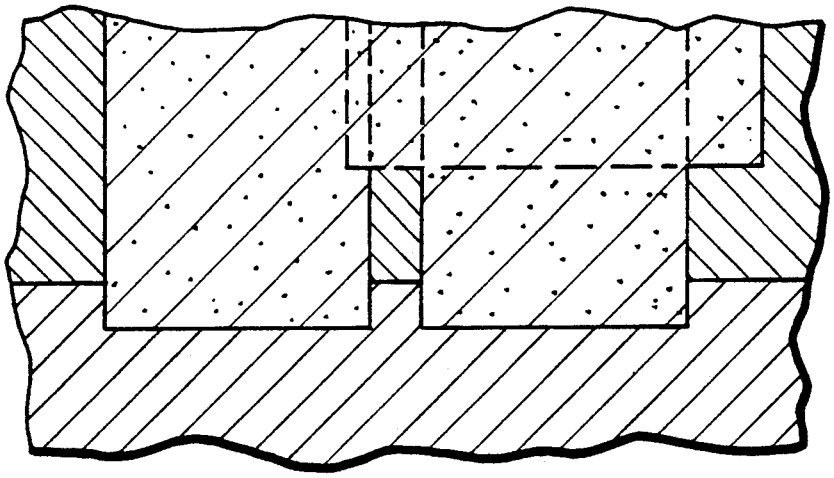
FIG. 15 is a cross-sectional elevation view of the two overlapping soilcrete columns as effected by the auger apparatus of FIG. 14.
Figure 16:
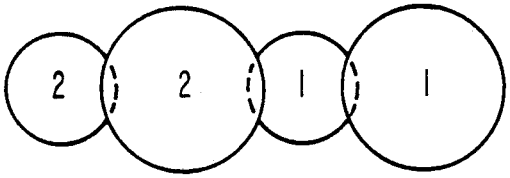
FIG. 16 is a cross-sectional view of two sets of boreholes effected by the apparatus of FIG. 14 showing overlap between the sets.
Figure 17:
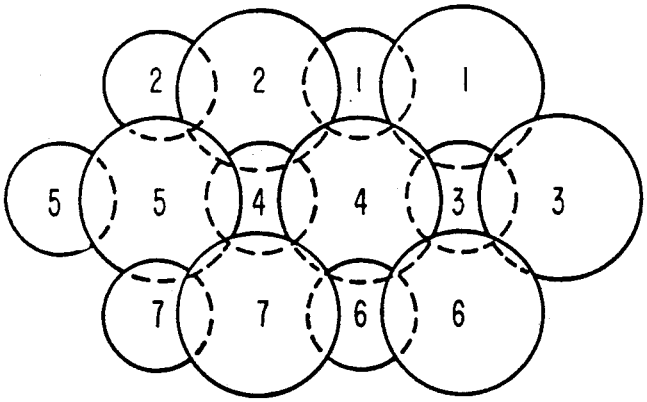
FIG. 17 is a cross-sectional view showing a grid comprised of three lines of overlapping boreholes effected by the apparatus of FIG. 14.

A still further embodiment of the present invention is depicted in FIG. 14. In this embodiment, two parallel augers are employed having shafts 70 and 72 with penetrating auger blades 74 and 76 attached at their respective ends. These auger blades are preferably, but not necessarily, of the type described previously in conjunction with FIG. 2. A flat overlapping blade 78 is also attached to shaft 72 offset somewhat above penetrating blade 76. Flat blade 78 has a diameter somewhat greater than penetrating blade 76. Use of this embodiment will result in two overlapping soilcrete columns as depicted in FIG. 15. As before, soilcrete walls may be effected by successive auger strokes effecting boreholes as depicted in FIG. 16. Likewise, soil fixation may be effected over an area by successive auger strokes effecting boreholes as depicted in FIG. 17. A variation of this embodiment would be one wherein four, or any even number of augers were employed.

Figure 18:
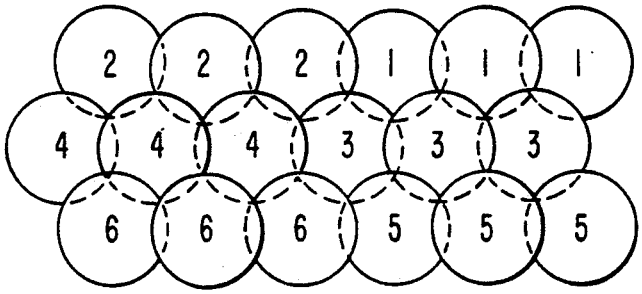
FIG. 18 is a cross-sectional view showing a grid comprised of three lines of overlapping boreholes effected by the apparatus of FIG. 2.

It should be noted that a configuration similar to that depicted in FIG. 11 may also be effected by three-shaft auger apparatus using strokes shown in FIG. 18. This arrangement may prove satisfactory for certain soils, and has the advantage over the arrangement of FIG. 11 in that fewer strokes will be required to effect a given number of columns.

Figure 19:
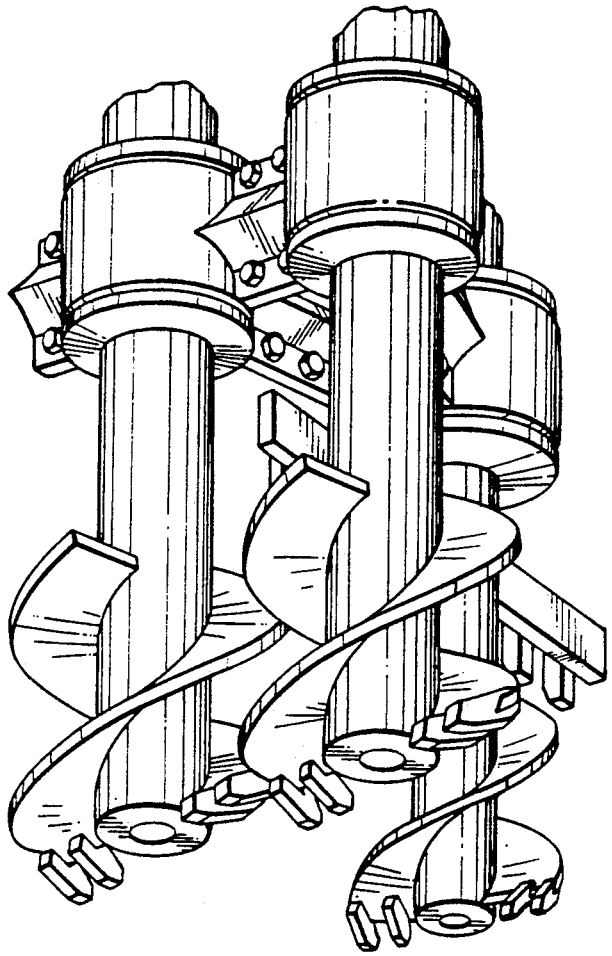
FIG. 19 is a perspective view of a three-shaft auger apparatus wherein the shafts are arranged in a triangular pattern.
Figure 20:
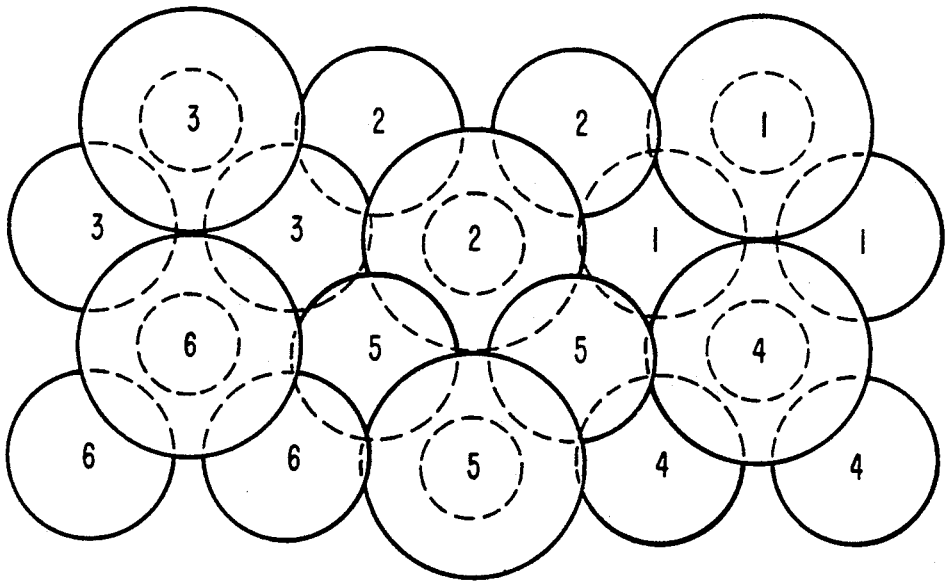
FIG. 20 is a cross-sectional view showing a grid comprised of four lines of overlapping boreholes effected by the apparatus of FIG. 19.

It should be noted that the previous description has disclosed methods and apparatus utilizing shafts in a coplanar arrangement. However, shafts may also be utilized in other arrangements such as triangular, square, pentagonal, etc. A grid of boreholes effected by an embodiment utilizing three shafts in a triangular arrangement (FIG. 19) is shown in FIG. 20. In this figure the borehole effected by the smaller-diameter penetrating auger blade is shown in phantom, for clarity.

The present invention may be embodied in other specific forms without departing from its spirit or essential characteristics. The described embodiments are to be restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A multi-shaft auger apparatus for boring into soil and mixing soil with a chemical hardener in situ to form hardened adjacent soilcrete columns, in situ, the apparatus comprising:

a plurality of substantially parallel shafts, each shaft having a lower end and an upper end, and adapted to be rotated;

a penetrating auger blade attached at the lower end of each respective shaft for boring into the soil to form a borehole, the individual auger blades being sized and spaced so as to prevent interference between adjacent auger blades as they rotate;

one or more separate overlapping auger blades attached respectively to one or more shafts, each of which is vertically offset from, and is larger in diameter than, the corresponding penetrating auger blade on its common shaft, and so sized and spaced as to effect a borehole that lies within the range of being approximately tangential to overlapping one or more adjacent boreholes effected by one or more adjacent penetrating auger blades;

means for injecting a chemical hardener into the soil through which the shafts bore; and means for securing the shafts together in a fixed space relationship.

2. A multi-shaft auger apparatus as defined in claim 1 wherein the means for injecting a chemical hardener comprises:

a passageway through each shaft;

a discharge opening at the lower end of each shaft in communication with the passageway through the shaft;

means for accepting the chemical hardener into the passageway at the upper end of each shaft as it is supplied thereto by a pump or other means.

3. A multi-shaft auger apparatus as defined in claim 1 wherein each overlapping auger blade has a diameter substantially the same as the adjacent penetrating auger blades.

4. A multi-shaft auger apparatus as defined in claim 1 wherein each overlapping auger blade has a diameter greater than the adjacent penetrating auger blades.

5. A multi-shaft auger apparatus as defined in claim 1 wherein the penetrating auger blades have cutting edges formed on the lower extremity of helical-shaped blades and a multiplicity of downwardly projecting auger teeth.

6. A multi-shaft auger apparatus as defined in claim 1 wherein each overlapping auger blade has a substantially flat blade with a multiplicity of downwardly projecting auger teeth.

7. A multi-shaft auger apparatus as defined in claim 1 wherein the shafts are sequentially arranged and each alternate penetrating auger blade has a diameter which is different than the diameter of adjacent auger blades.

8. A multi-shaft auger apparatus as defined in claim 7 wherein alternate augers are so fashioned as to be preferably rotated in opposite directions to adjacent augers.

9. A multi-shaft auger apparatus as defined in claim 7 wherein the penetrating auger blades are substantially in horizontal alignment with each other.

10. A multi-shaft auger apparatus as defined in claim 7 wherein alternate penetrating auger blades are offset vertically from adjacent penetrating auger blades.

11. A multi-shaft auger apparatus as defined in claim 1 wherein one or more of the shafts have one or more mixing paddles attached thereto intermediate their length to aid in mixing the chemical hardener with the soil.

12. A multi-shaft auger apparatus as defined in claim 1 wherein one or more of the shafts have one or more additional penetrating auger blades attached thereto intermediate their length.

13. A multi-shaft auger apparatus as defined in claim 1 wherein the plurality of substantially parallel shafts comprises two substantially parallel shafts.

14. A multi-shaft auger apparatus as defined in claim 1 wherein the plurality of substantially parallel shafts comprises three coplanar substantially parallel shafts.

15. A multi-shaft auger apparatus as defined in claim 1 wherein the plurality of substantially parallel shafts comprises three substantially parallel shafts arranged in a triangular pattern.

16. A multi-shaft auger apparatus as defined in claim 1 wherein the plurality of substantially parallel shafts comprises five coplanar substantially parallel shafts.

17. A method for forming adjacent soilcrete columns in situ in soil using a multi-shaft auger apparatus comprising the steps of:

(a) effecting in a first auger stroke two or more adjacent first-stroke boreholes in soil with a multi-shaft auger apparatus having a plurality of substantially parallel shafts, each shaft having a penetrating auger blade attached at a lower end of its shaft, and one or more shafts having each an overlapping auger blade attached at a position offset vertically from the corresponding penetrating auger blade which is positioned at the lower end of said one or more shafts, and wherein said overlapping auger blade has a diameter greater than said corresponding penetrating auger blade;

(b) injecting a chemical hardener into the soil in two or more boreholes during the auger stroke;

(c) blending the soil and the chemical hardener during the auger stroke; and (d) withdrawing the multi-shaft auger apparatus from the boreholes, leaving the boreholes substantially filled with soilcrete mixture, thus effecting two or more soilcrete columns.

18. A method for forming adjacent soilcrete columns in situ in soil as defined in claim 17 comprising further the steps of:

(e) moving the multi-shaft auger apparatus to a new position such that at least one shaft is adjacent to at least one first-stroke borehole and also such that the borehole to be effected by said one shaft will be within the range of being approximately tangential to overlapping said one first-stroke borehole;

(f) effecting in a second auger stroke two or more second-stroke boreholes;

(g) injecting a chemical hardener into the soil in one or more boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three or more soilcrete columns.

19. A method for forming adjacent soilcrete columns in situ in soil as defined in claim 18 comprising further the steps of:

(j) repeating the steps of moving, effecting additional boreholes in additional auger strokes, injecting a chemical hardener, blending, and withdrawing the multi-shaft auger apparatus from the boreholes, thus effecting a multiplicity of soilcrete columns, all in such a manner that interstitial spaces between adjacent columns are substantially minimized.

20. A method for forming adjacent soilcrete columns in situ in soil as defined in claim 17 comprising further the steps of:

(e) moving the multi-shaft auger apparatus to a new position such that at least one of the penetrating auger blades effects a second-stroke borehole that is substantially coaxial with a first-stroke borehole effected by a penetrating auger blade in the first auger stroke;

(f) effecting in a second auger stroke two or more second-stroke boreholes;

(g) injecting a chemical hardener into the soil in one or more boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three or more soilcrete columns.

21. A method for forming adjacent soilcrete columns in situ in soil as defined in claim 20 comprising further the steps of:

(j) repeating the steps of moving, effecting additional boreholes in additional auger strokes, injecting a chemical hardener, blending, and withdrawing the multi-shaft auger apparatus from the boreholes, thus effecting a multiplicity of soilcrete columns, all in such a manner that interstitial spaces between adjacent columns are substantially minimized.

22. A method for forming adjacent soilcrete columns in situ in soil as defined in claim 17 wherein the multi-shaft auger apparatus has three coplanar shafts, the central shaft has the overlapping auger blade attached to it, and said overlapping auger blade has substantially the same diameter as the penetrating auger blades attached to the adjacent shafts.

23. A method for forming adjacent soilcrete columns in situ in soil as defined in claim 22 comprising further the steps of:

(e) moving the multi-shaft auger apparatus to a new position such that at least one shaft is adjacent to at least one first-stroke borehole an also such that the borehole to be effected by said one shaft will be within the range of being approximately tangential to overlapping said one first-stroke borehole;

(f) effecting in a second auger stroke two or more second-stroke boreholes;

(g) injecting a chemical hardener into the soil in one or more boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three or more soilcrete columns.

24. A method for forming adjacent soilcrete columns in situ in soil as defined in claim 23 comprising further the steps of:

(j) effecting a first planar row of columns;

(k) effecting one or more additional planar rows of columns substantially parallel to said first planar row of columns, wherein each column in said additional planar row is offset longitudinally in its plane by a distance equal to approximately one-half the diameter of a column, and wherein the spacing between adjacent planar rows is somewhat less than the diameter of a column and is such as to at least substantially minimize interstitial spaces between columns.

25. A method for forming adjacent soilcrete columns in situ in soil as defined in claim 17 comprising further the steps of:

(e) moving the multi-shaft auger apparatus to a new position such that at least one of the penetrating auger blades effects a second-stroke borehole that is substantially coaxial with a first-stroke borehole effected by a penetrating auger blade in the first auger stroke;

(f) effecting in a second auger stroke two or more second-stroke boreholes;

(g) injecting a chemical hardener into the soil in one or more boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three or more soilcrete columns.

26. A method for forming adjacent soilcrete columns in situ in soil as defined in claim 25 comprising further the steps of:

(j) effecting a first planar row of columns;

(k) effecting one or more additional planar rows of columns substantially parallel to said first planar row of columns, wherein each column in said additional planar row is offset longitudinally in its plane by a distance equal to approximately one-half the diameter of a column, and wherein the spacing between adjacent planar rows is somewhat less than the diameter of a column and is such as to at least substantially minimize interstitial spaces between columns.

27. A method for forming adjacent soilcrete columns in situ in soil as defined in claim 17 wherein the multi-shaft auger apparatus has three coplanar shafts, the central shaft has the overlapping auger blade attached to it, and said overlapping auger blade has a larger diameter than the penetrating auger blades attached to the adjacent shafts.

28. A method for forming adjacent soilcrete columns in situ in soil as defined in claim 27 comprising further the steps of:

(e) moving the multi-shaft auger apparatus to a new position such that at least one shaft is adjacent to at least one first-stroke borehole and also such that the borehole to be effected by said one shaft will be within the range of being approximately tangential to overlapping said one first-stroke borehole;

(f) effecting in a second auger stroke two or more second-stroke boreholes;

(g) injecting a chemical hardener into the soil in one or more boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three or more soilcrete columns.

29. A method for forming adjacent soilcrete columns in situ in soil as defined in claim 27 comprising further the steps of:

(e) moving the multi-shaft auger apparatus to a new position such that at least one of the penetrating auger blades effects a second-stroke borehole that is substantially coaxial with a first-stroke borehole effected by a penetrating auger blade in the first auger stroke;

(f) effecting in a second auger stroke two or more second-stroke boreholes;

(g) injecting a chemical hardener into the soil in one or more boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three or more soilcrete columns.

30. A method for forming adjacent soilcrete columns in situ in soil as defined in claim 29 comprising further the steps of:

(j) effecting a first planar row of columns;

(k) effecting one or more additional planar rows of columns substantially parallel to said first planar row of columns, wherein each column of larger diameter is orthogonally positioned with respect to a smaller-diameter column in an adjacent planar row of columns, and wherein the spacing between adjacent planar rows is approximately equal to the diameter of a smaller diameter column and is such as to at least substantially minimize interstitial spaces between columns.

31. A method for forming adjacent soilcrete columns in situ in soil as defined in claim 17 wherein the multi-shaft auger apparatus comprises two shafts.

32. A method for forming adjacent soilcrete columns in situ in soil as defined in claim 31 comprising further the steps of:

(e) moving the multi-shaft auger apparatus to a new position such that at least one shaft is adjacent to at least one first-stroke borehole and also such that the borehole to be effected by said one shaft will be within the range of being approximately tangential to overlapping said one first-stroke borehole;

(f) effecting in a second auger stroke two or more second-stroke boreholes;

(g) injecting a chemical hardener into the soil in one or more boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three or more soilcrete columns.

33. A method for forming adjacent soilcrete columns in situ in soil as defined in claim 32 comprising further the steps of:

(j) effecting a first planar row of columns;

(k) effecting one or more additional planar rows of columns substantially parallel to said first planar row of columns, wherein each column of larger diameter is orthogonally positioned with respect to a smaller-diameter column in an adjacent planar row of columns, and wherein the spacing between adjacent planar rows is approximately equal to the diameter of a smaller diameter column and is such as to at least substantially minimize interstitial spaces between columns.

34. A method for forming adjacent soilcrete columns in situ in soil as defined in claim 17 using a three-shaft auger apparatus comprising the steps of:

(a) effecting in a first auger stroke three adjacent first-stroke boreholes in situ with a three-shaft auger apparatus having three substantially parallel shafts spaced apart in a triangular relationship, each shaft having a penetrating auger blade attached at a lower end of its shafts, and one shaft having an overlapping auger blade attached at a position offset vertically from the corresponding penetrating auger blade which is positioned at the lower end of said one shaft, and wherein said corresponding penetrating auger blade has a diameter greater than said corresponding penetrating auger blade;

(b) injecting a chemical hardener into the soil into the boreholes during the auger stroke;

(c) blending the soil and the chemical hardener during the auger stroke; and (d) withdrawing the multi-shaft auger apparatus from the boreholes, leaving the boreholes substantially filled with the soilcrete mixture, thus effecting three soilcrete columns wherein one has a larger diameter than the other two.

35. A method for forming adjacent soilcrete columns in situ in soil as defined in claim 34 comprising further the steps of:

(e) moving the three-shaft auger apparatus to a new position such that the axis of the shaft carrying the overlapping auger blade and one penetrating auger blade lies in the plane of the axes of the two smaller soilcrete columns formed in the first stroke, and the axes of the other two penetrating auger blades lie in a common plane with the axis of the larger diameter soilcrete column formed in the first stroke, and further such that one penetrating auger blade overlaps the larger diameter soilcrete column;

(f) effecting in a second auger stroke three more second-stroke boreholes;

(g) injecting a chemical hardener into the soil into the boreholes during the second auger stroke;

(h) blending the soil and the chemical hardener during the auger stroke; and (i) withdrawing the multi-shaft auger apparatus from the boreholes, leaving the boreholes substantially filled with the soilcrete mixture, thus effecting three more soilcrete columns which together with the columns formed during the first stroke form a double row of columns.

36. A method for forming adjacent soilcrete columns in situ in soil as defined in claim 35 comprising further the steps of:

(j) repeating the steps of moving, effecting additional boreholes in additional auger strokes, injecting a chemical hardener, blending, and withdrawing the three-shaft auger apparatus from the boreholes, thus effecting a multiplicity of soilcrete columns in a double row, all in such a manner that interstitial spaces between adjacent columns are substantially minimized.

37. A method for forming adjacent soilcrete columns in situ in soil as defined in claim 36 comprising further the steps of:

(k) effecting one or more additional double rows of columns substantially parallel to said first double row of columns, wherein the axis of each column of larger diameter is orthogonally positioned from a larger-diameter column in an adjacent double row of columns, and wherein the spacing between adjacent double rows is such as to at least substantially minimize interstitial spaces between rows.

* * * * *